US005323608A

United States Patent [19]

Honma

[11] Patent Number: 5,323,608

[45] Date of Patent: Jun. 28, 1994

[54] EXHAUST PURIFYING DEVICE

[75] Inventor: Hideaki Honma, Saitama, Japan

[73] Assignee: Sankei Giken Kogyo Kabushiki Kaisha, Tokyo, Japan

[21] Appl. No.: 22,492

[22] Filed: Feb. 25, 1993

[30] Foreign Application Priority Data

Feb. 28, 1992 [JP] Japan ..... 4-009697[U]

[51] Int. Cl.[5] ..... F01N 3/28

[52] U.S. Cl. ..... 60/299; 422/180

[58] Field of Search ..... 60/299; 422/179, 180

[56] References Cited

U.S. PATENT DOCUMENTS 4,348,360 9/1982 Chang ..... 422/180
5,055,275 10/1991 Kanniainen ..... 422/179
5,163,291 11/1992 Hitachi ..... 422/180

FOREIGN PATENT DOCUMENTS 0243952 4/1987 European Pat. Off. .
2752716 11/1977 Fed. Rep. of Germany .
8909740 8/1989 Fed. Rep. of Germany .
6394015 8/1986 Japan .
1452982 1/1974 United Kingdom .

*Primary Examiner*—Douglas Hart

[57] ABSTRACT

An exhaust purifying device for reducing toxic components contained in an exhaust emanating from an internal combustion engine. The device has a casing connected at both ends thereof to an exhaust system extending from the engine, and a core received in the casing and provided with a honeycomb structure constituted by a corrugated sheet and a flat sheet which are rolled up together in a spiral configuration. A pair of retaining members are received in axially opposite ends of the casing for preventing the core from moving in the axial direction and circumferential direction relative to the casing. Each of the retaining members radially traverses the associated end of the casing and includes a biting portion slightly biting into the associated end of the core.

9 Claims, 5 Drawing Sheets

EXHAUST PURIFYING DEVICE

BACKGROUND OF THE INVENTION

1. Field of the Invention

The present invention relates to a device incorporated in the exhaust system of an automotive or similar internal combustion engine for purifying exhaust gases emanating from the engine and, more particularly, to an exhaust purifying device of the type using a metallic core having a honeycomb structure and coated with a catalyst.

2. Description of the Related Art

An exhaust purifying device or so-called catalytic converter has customarily been incorporated in the exhaust system of an automotive or similar internal combustion engine, e.g., an exhaust pipe or a muffler. Provided with a catalyst, the catalytic converter promotes the oxidation of carbon monoxide, hydrocarbons and other toxic components contained in exhaust gases emanating from the engine. One of conventional catalytic converters has a cylindrical casing attached to predetermined part of, for example, a muffler, and a metallic honeycomb core received in the casing and coated with a catalyst. The honeycomb core is made up of a corrugated sheet of metal and a flat sheet of metal which are rolled up together in a spiral configuration. Such a core is inserted into the casing and then soldered together with the casing. As a result, the corrugated sheet and flat sheet are bonded together to prevent the honeycomb structure from being deformed while, at the same time, the outer periphery of the core is bonded to the inner periphery of the casing to prevent the core from moving in the casing. However, the problem with this kind of catalytic converter is that the soldering operation is complicated and time-consuming. This, coupled with the fact that the solder itself is expensive, increases the cost of the catalytic converter.

To eliminate the above problem particular to soldering, Japanese Patent Laid-Open Publication No. 94015/1988, for example, discloses an exhaust purifying device in which a core is received in a cylindrical casing, but the former is not soldered to the latter. Specifically, retaining members are each affixed to one end of the casing in such a manner as to extend through the center of the opening of the casing. The retaining members prevent the core from slipping out of the casing and prevent the radially central portion of the core from protruding from the casing in an auger-like configuration. On the other hand, U.K. Patent 1452982 teaches an exhaust purifying device having similar support members affixed to opposite ends of a casing.

However, the conventional retaining members or support members affixed to the cylindrical casing as stated above simply restrict the core in the axial direction of the casing, i.e., they cannot cope with the movement of the core in the circumferential direction. As a result, when an automotive vehicle with such an exhaust purifying device is in travel, the core is apt to move in the circumferential direction within the casing due to the stream and heat of engine exhaust, vibration of the vehicle body and so forth. Specifically, it is likely that the core rotates within the casing while the corrugated sheet and flat sheet shift and rub against each other within the core. This would cause the catalyst to come off the core while cracking or breaking the core itself, degrading the expected function of the device.

SUMMARY OF THE INVENTION

It is, therefore, an object of the present invention to provide an exhaust purifying device capable not only of restricting a core in the axial direction in a casing and preventing it from being deformed, but also of preventing the core from rotating in the casing while preventing members forming the cells of the core from shifting relative to each other.

An exhaust purifying device for reducing toxic components contained in an exhaust emanating from an internal combustion engine of the present invention comprises a casing to be connected at both ends thereof to an exhaust system extending from the internal combustion engine, and a core received in the casing and provided with a honeycomb structure constituted by a corrugated sheet and a flat sheet which are rolled up together in a spiral configuration. A pair of retaining members are received in axially opposite ends of the casing for preventing the core from moving in the axial direction and circumferential direction relative to the casing. The retaining members each radially traverses the associated end of the casing and includes a biting portion slightly biting into the associated end of the casing.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
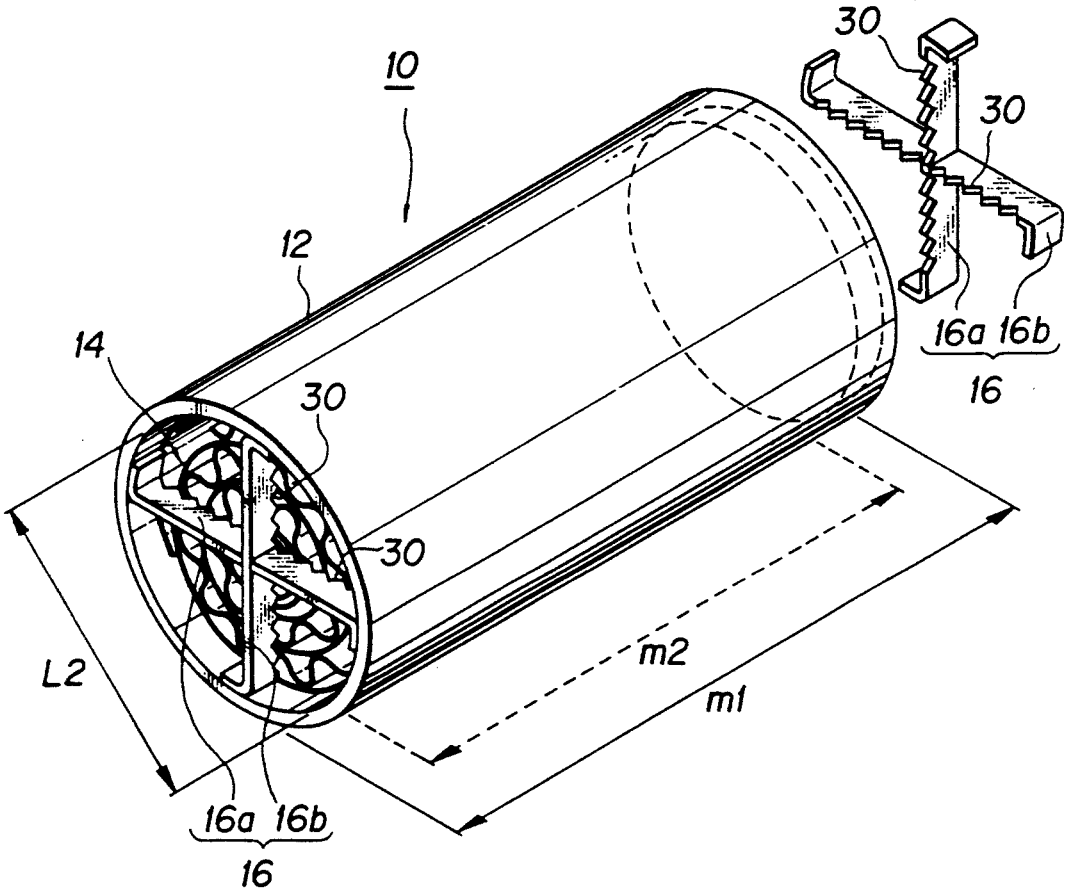
FIG. 1 is a perspective view showing an exhaust purifying device embodying the present invention.

Referring to FIG. 1 of the drawings, an exhaust purifying device or catalytic converter embodying the present invention is shown and generally designated by the reference numeral 10. As shown, the catalytic converter 10 has a hollow cylindrical casing 12 and a honeycomb core 14 made of metal and received in the casing 12. The casing 12 is welded or otherwise affixed to, for example, a muffler or an exhaust pipe of an automobile to form part of an exhaust passage. A catalyst is applied to the honeycomb core 14. In the illustrative embodiment, the core 14 is not soldered or otherwise affixed to the casing 12. Generally cruciform retaining members 16 are positioned at opposite ends of the casing 12, and each bites into adjoining end of the core 14.

Specifically, the casing 12, like the muffler or the exhaust pipe, is formed of a steel sheet having a predetermined strength great enough to resist the high-temperature and high-pressure engine exhaust. The steel sheet may be implemented as a stainless steel sheet which is 1 millimeter to 3 millimeters thick. The casing 12 is provided with a cross-section matching that of the muffler or the exhaust pipe, e.g., a circular, elliptical or partly curved rectangular cross-section. In the embodiment, let the casing 12 be assumed to have a circular cross-section for the sake of illustration. Also, in the embodiment, the casing 12 has a length m1 which is about 10 millimeters longer than the length m2 of the honeycomb core 14. Each end of the core 14 stands back from the adjoining end of the casing 12 by about 5 millimeters.

Figure 2:
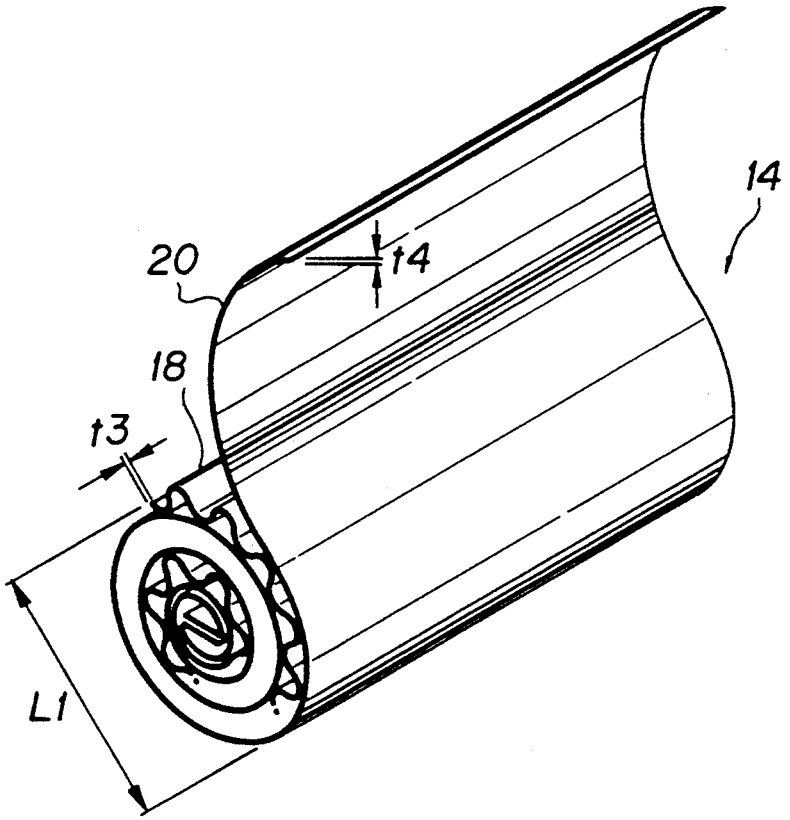
FIG. 2 is a perspective view showing a core included in the embodiment specifically.

As shown in FIG. 2, the honeycomb core 14 is constituted by a corrugated sheet or vent sheet 18 and a flat sheet or partition sheet 20 laid one above the other. The corrugated sheet 18 and flat sheet 20 are rolled up together in a spiral configuration to form exhaust passageways extending in the axial direction of the core 14. The exhaust passageways are separated both in the radial direction and in the circumferential direction, thereby forming a honeycomb structure. Received in the casing 12, the core 14 has an outside diameter L1 slightly smaller than or substantially equal to the inside diameter L2 (see FIG. 1) of the casing 12. Specifically, the vent sheet 18 is formed by corrugating an elongate thin sheet metal and coating both surfaces of the corrugated sheet with a catalyst, e.g., platinum, palladium or rhodium. For example, the vent sheet 18 is implemented by a thin stainless steel sheet which is highly resistive to the high-temperature and high-pressure engine exhaust and, in addition, flexible enough to be rolled. In the illustrative embodiment, the vent sheet 18 has a thickness t3 of about 50 microns to about 100 microns. The vent sheet 18 is rolled up with the intermediary of the partition sheet 20 in a spiral to divide the exhaust passage of the muffler or that of the exhaust pipe into a plurality of passageways in the circumferential direction of the core 14. The passageways each extends along the axis of the core 14. This configuration allows the engine exhaust to contact the core 14 over a broad area. The partition sheet 20, like the vent sheet 18, is constituted by an elongate thin stainless steel sheet whose opposite surfaces are coated with palladium, rhodium or similar catalyst. The partition sheet 20 also has a thickness t4 of about 50 microns to 100 microns. At the beginning of rolling, the partition sheet 20 is arranged along the bottoms of the corrugations of the vent sheet 18 to form a core portion. Then, the sheet 20 is sequentially rolled in a spiral along the bottoms of the corrugations of the sheet 18 to define the cells of the honeycomb in the radial direction. As a result, the sheet 20 closes the upper and lower axially extending channels of the sheet 18 to guarantee a sufficient area over which the engine exhaust flowing through the core 14 contacts the catalysts. Finally, the sheet 20 forms the outer periphery of the core 16 enclosing the peaks of the corrugations of the sheet 18.

Figure 3A:
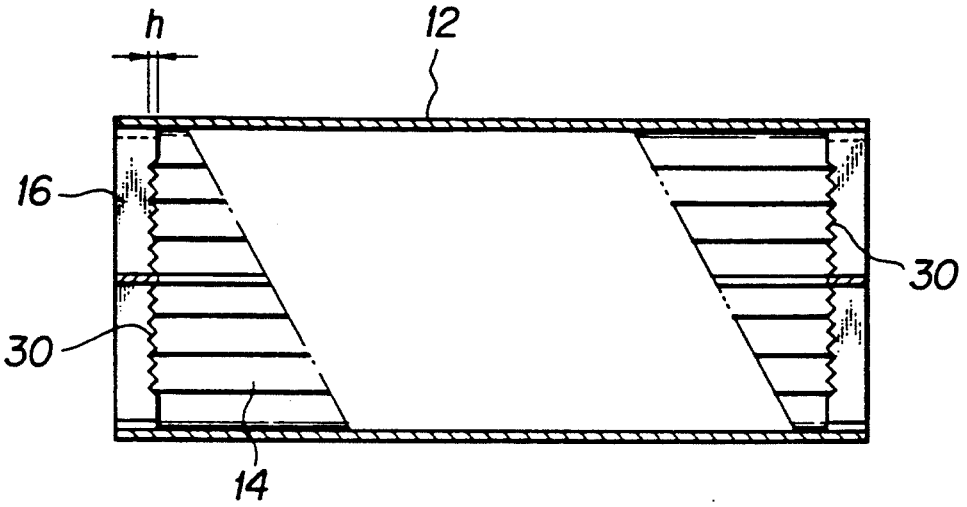
FIG. 3A is a section view showing the embodiment in a condition wherein retaining members are attached to a casing.
Figure 3B:
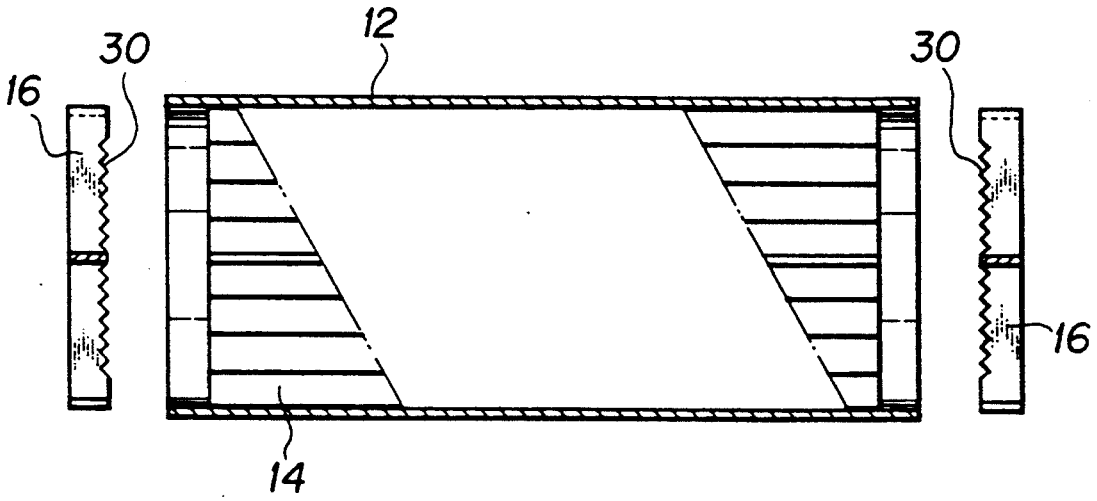
FIG. 3B is a view similar to FIG. 3A, showing a condition wherein the retaining members are attached to the casing.

Referring again to FIG. 1, the cruciform retaining members 16 located at opposite ends of the casing 12 are each constituted by two elongate flat pieces, or bars, 16*a* and 16*b*. Each of the bars 16*a* and 16*b* is slightly bent at both ends thereof in opposite directions and in a shape complementary to the inner periphery of the casing 12. Specifically, the bars 16*a* and 16*b* are implemented as stainless steel sheets which are about 1 millimeter thick and about 5.5 millimeters wide. While such stainless steel sheets originally have a length greater than the inside diameter L2 of the casing 12, they are bent at both ends thereof to be received in the casing 12. The bars 16*a* and 16*b* are each formed with a slit widthwise at substantially the intermediate between opposite ends and are joined together perpendicularly to each by means of such slits. In the illustrative embodiment, the bars 16*a* and 16*b* are each formed with a saw-toothed portion 30 at one side edge thereof. As shown in FIG. 3A, the saw-toothed portion 30 has teeth whose height h ranges from about 0.5 millimeter to about 1.0 millimeters. The teeth are caused to bite into the core 14 by the following specific, but not limitative, procedure. One of the retaining members 16 is inserted into the casing 12 and positioned such that the end of the member 16 void of the teeth is flush with the end of the casing 12. The bent ends of this retaining member 16 are welded or otherwise connected to the inner periphery of the casing 12. Subsequently, the honeycomb core 14 is inserted into the casing 12 from the other end opposite to the retaining member 16 connected to the casing 12. After the core 14 has abutted against the retaining member 16 at one end thereof, the other retaining member 16 is forced into the casing 12 until the end thereof void of the teeth becomes flush with the other end of the casing 12. Then, this retaining member 16 is affixed to the casing 12 by welding or similar technology. Alternatively, the two retaining members 16 may be forced into opposite ends of the casing 12 in such a manner as to slightly press the adjoining ends of the core 14, in which case the members 16 will be affixed to the casing 12 after a predetermined load has been detected. In any case, the retaining members 16 are positioned in the casing 12 such that their teeth slightly bite into opposite ends of the core 14.

The casing 12 of the catalytic converter 10 having the above structure is welded or otherwise connected at both ends thereof to the intermediate portion of, for example, the exhaust pipe or the muffler of an automobile. The high-temperature exhaust from an engine mounted on the automobile flows into the core 14 via one end of the casing 12. Then, the exhaust is distributed to the number of passageways or cells of the honeycomb core 14 defined by the vent sheet 18 and partition sheet 20. At this instant, the catalyst applied to the two sheets 18 and 20 promote the oxidation of the exhaust, i.e., causes it to recombust. As a result, the exhaust coming out of the core 16 contains a minimum of carbon monoxide, hydrocarbons and other toxic components. Finally, the purified engine exhaust is emitted to the atmosphere.

While the automobile with the catalytic converter 10 is in travel, the honeycomb core 14 implemented by thin stainless steel sheets is apt to move in the axial direction due to, for example, the vibration of the vehicle body. However, the retaining members 16 affixed to the casing 12 and bitten into both ends of the core 14 prevent the retaining members 16 from moving in the above-mentioned direction. Since the retaining members 16 have a cruciform shape and retain the radially central portions of the core 14, they prevent the core 14 from being deformed in an auger-like configuration. Further, as the vehicle body vibrates and the engine exhaust flows through the honeycomb passageways under a high pressure, the core 14 is also apt to rotate relative to the casing 12 while the vent sheet 18 and partition sheet 20 are apt to shift relative to each other. The illustrative embodiment minimizes such an occurrence since the retaining members 16 press the core 14 with a predetermined force from both sides and since the saw-toothed portions 30 of the members 16 which are perpendicular to each other bite into the two sheets 18 and 20 of the core 14 in the radial direction. This prevents the catalysts from coming off the sheets 18 and 20 and protects the core 17 from cracks or similar damage, thereby enhancing the service life of the catalytic converter 10. In addition, the saw-toothed portions 30 of the retaining members 16 do not crush the ends of the core 14 more than necessary and bite into the core 14 only at points, i.e., not on lines. Hence, the teeth 30 allow the ends of the core 14 to adequately adapt thereto, thereby more surely eliminating the undesirable movement of the core 14.

Figure 4:
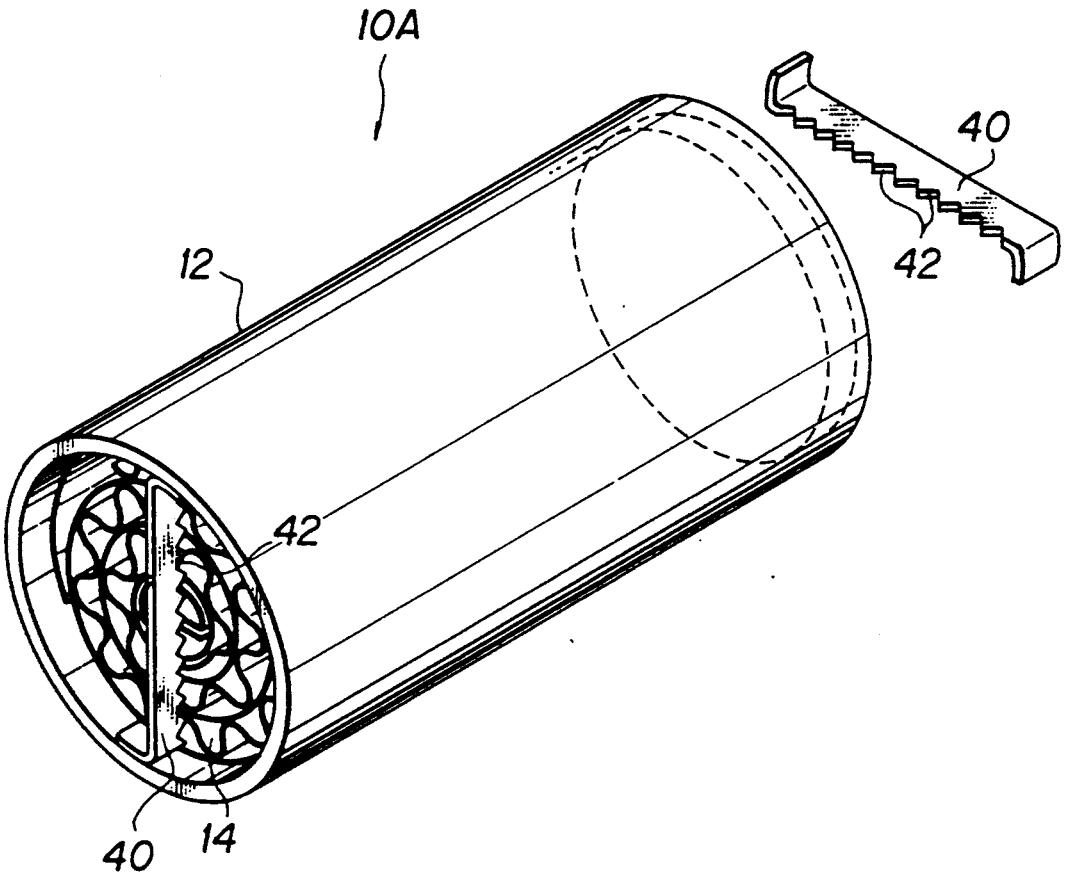
FIGS. 4 and 5 each shows an alternative embodiment of the exhaust purifying device in accordance with the present invention.

FIG. 4 shows an alternative embodiment of the present invention. In FIG. 4, the same or similar constituents as or to the constituents of the previous embodiment are designated by the same reference numerals, and a redundant description will be avoided for simplicity. As shown, a catalytic converter, generally 10A, has retaining members 40 each being implemented as a single elongate member or bar which is bent at both ends thereof. The retaining members 40 are welded or otherwise affixed to opposite ends of the casing 12 perpendicularly to each other. Each retaining member 40 is formed with a saw-toothed portion 42 which bites into the adjoining end of the core 14, as in the previous embodiment.

Figure 5:
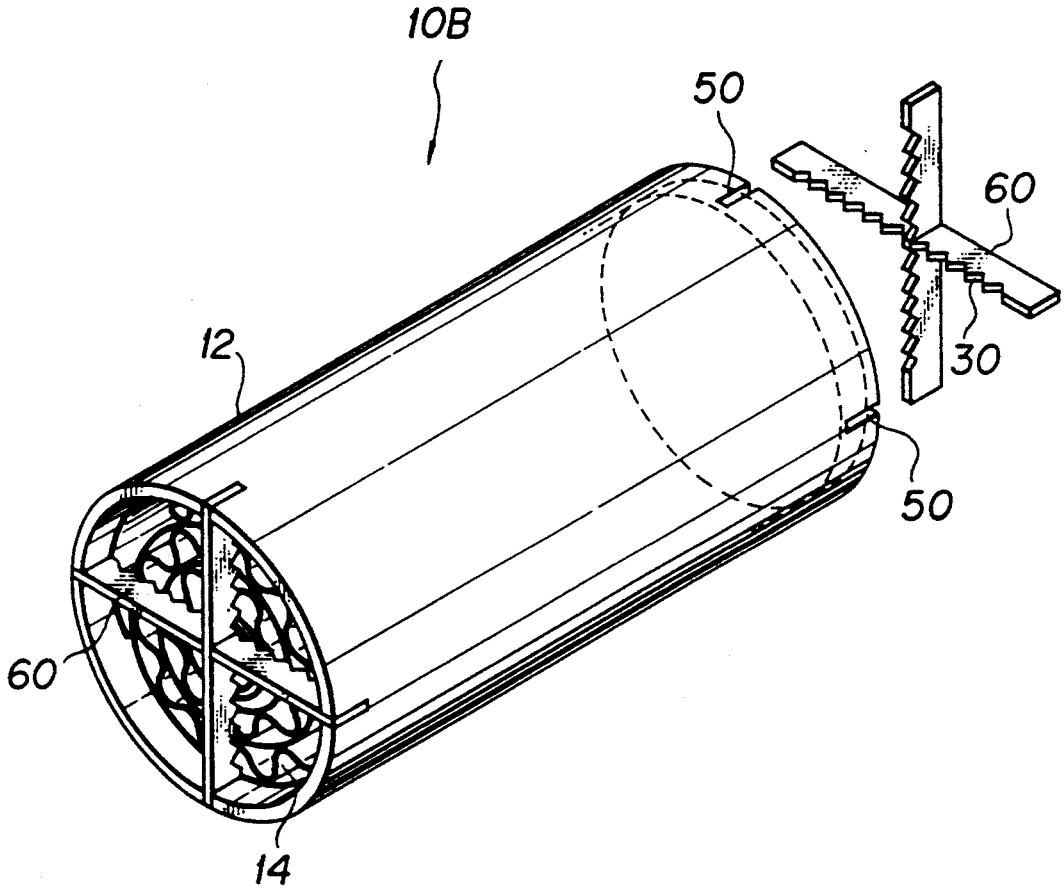

FIG. 5 shows another alternative embodiment of the present invention. In FIG. 5, the same or similar constituents as or to the constituents of the previous embodiments are designated by the same reference numerals, and a redundant description will be avoided for simplicity. As shown, a catalytic converter, generally 10B, is essentially similar to the catalytic converter 10 of FIG. 1 except for the means for affixing the retaining members to the casing. Specifically, the casing 12 of the catalytic converter 10B is formed with four notches at equally spaced locations along the circumference at each end thereof. Retaining members 60 differ from the retaining members 16, FIG. 1, in that they are not bent at opposite ends thereof. The retaining members 60 are each received in the notches 50 of one end of the casing 12 and fixed in place by caulking.

In summary, in accordance with the present invention, an exhaust purifying device has retaining members provided with saw-toothed portions and affixed to both ends of a cylindrical casing. The saw-toothed portions bite into both ends of a honeycomb core disposed between the retaining members. As a result, the core is preventing from rotating relative to the casing while members constituting the core are prevented from shifting relative to each other. This prevents catalysts from coming off the members of the core and protects the core from damage despite that the core is not soldered or otherwise fixed to the casing. The device of the invention is, therefore, easy to fabricate, inexpensive, and has a long life.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. For example, the saw-toothed portions 30 or 42 are only illustrative and may be provided with any other suitable configuration. Of course, the present invention is applicable not only to an automobile but also to any other motor vehicle, e.g., a motorcycle.

What is claimed is:

1. An exhaust purifying device for reducing toxic components contained in an exhaust emanating from an internal combustion engine, said device comprising:

a casing to be connected at both ends thereof to an exhaust system extending from the internal combustion engine;

a core received in said casing and provided with a honeycomb structure constituted by a corrugated sheet and a flat sheet which are rolled up together in a spiral configuration; and a pair of retaining members received in axially opposite ends of said casing for preventing said core from moving in an axial direction and a circumferential direction relative to said casing, said pair of retaining members each radially traversing the associated end of said casing and including a biting portion slightly biting into said associated end of said core.

2. A device as claimed in claim 1, wherein said pair of retaining members each comprises a cruciform retaining member.

3. A device as claimed in claim 2, wherein said cruciform retaining member is soldered to an inner periphery of said casing.

4. A device as claimed in claim 2, wherein said cruciform retaining member is inserted into notches formed in said casing and then caulked.

5. A device as claimed in claim 2, wherein said biting portion comprises a saw-toothed portion.

6. A device as claimed in claim 1, wherein said pair of retaining members each comprises an elongate flat retaining member.

7. A device as claimed in claim 6, wherein said elongate flat retaining member is soldered to an inner periphery of said casing.

8. A device as claimed in claim 6, wherein said biting portion comprises a saw-toothed portion.

9. A device as claimed in claim 1, wherein said pair of retaining members are fitted in said casing in such a manner as to slightly compress said core in the axial direction thereof.

* * * * *